United States Patent [19]

Haneda et al.

[11] Patent Number: 4,754,725

[45] Date of Patent: Jul. 5, 1988

[54] SUPERCRITICAL SLIDING PRESSURE OPERATION BOILER WITH REAR GAS DUCT

[75] Inventors: Hisao Haneda; Mamoru Araoka; Toshihiro Kamata; Tetsuo Sada, all of Tokyo, Japan

[73] Assignee: Mitsubishi Jukogyo Kabushiki Kaisha, Tokyo, Japan

[21] Appl. No.: 37,053

[22] Filed: Apr. 13, 1987

Related U.S. Application Data

[63] Continuation of Ser. No. 822,586, Jan. 15, 1986, abandoned.

[30] Foreign Application Priority Data

Feb. 20, 1985 [JP] Japan ..... 60-32494

[51] Int. Cl.[4] ..... F22G 7/14

[52] U.S. Cl. ..... 122/476; 122/480

[58] Field of Search ..... 122/4 D, 6 R, 235 F, 122/355, 356, 460, 468–471, 474, 476, 479 D, 480, DIG. 3, DIG. 6

[56] References Cited

U.S. PATENT DOCUMENTS

| | | | |
|---|---|---|---|
| 2,926,636 | 3/1960 | Paulison, Jr. | 122/479 D |
| 2,984,984 | 5/1961 | Dickey | 122/479 D |
| 2,985,152 | 5/1961 | Paulison, Jr. | 122/479 D |
| 3,033,177 | 5/1962 | Koch | 122/480 |

*Primary Examiner*—Steven E. Warner

*Attorney, Agent, or Firm*—Wenderoth, Lind & Ponack

[57] ABSTRACT

A boiler having a furnace, a tunnel section and a rear gas duct is improved by the fact that a partition wall at right angles to side walls of the rear gas duct is disposed in the rear gas duct to divide it into two passages. A low-pressure reheater is disposed in the divided passage nearest to the tunnel section and has a narrow width. Two partition walls are disposed in the other divided passage parallel to the side walls of the rear gas duct to further divide the passage into three passages. Superheaters are disposed in the further divided passages close to the side walls and a high-pressure reheater is disposed in the central further divided passage. In another embodiment, the locations of the superheater and the high-pressure reheater are reversed.

3 Claims, 2 Drawing Sheets

SUPERCRITICAL SLIDING PRESSURE OPERATION BOILER WITH REAR GAS DUCT

This application is a continuation of now abandoned application Ser. No. 822,586, filed Jan. 15, 1986.

BACKGROUND OF THE INVENTION

1. Field of the Invention

The present invention relates to improvements in a boiler of the type that consists of a furnace, a tunnel section at the upper portion of the furnace and a rear gas duct. The gas duct is divided into a plurality of passages. Reheaters and superheaters are provided separately in the respective passages, and flow rates of combustion gases flowing through the respective passages are made adjustable.

2. Description of the Prior Art

The type of boilers of the prior art mentioned above will be described with reference to FIGS. 5 and 6.

First, in a boiler illustrated in FIG. 5, a rear gas duct is provided with two partition walls 52 which intersect with side walls 51 of the rear gas duct perpendicular thereto. Thus, the rear gas duct is divided into three passages. A low-pressure reheater LP, a high-pressure reheater HP and a superheater SH are disposed in these respective passages in sequence starting from the passage nearest to a tunnel section 53. Dampers are disposed in the respective portions of the three divided passages proximte the lower ends of the partition walls 52.

Combustion gas coming from a furnace 54 passes through the tunnel section 53, and thereafter enters the rear gas duct. At this time, the combustion gas passes through only the passage in which the superheater SH is disposed. If the dampers are closed in the passages where the low-pressure reheater LP and the high-pressure reheater HP are disposed, respectively. Combustion gas passes through the passages where the low-pressure reheater LP and the superheater SH are disposed, respectively, if the dampers are closed in the passage in which the high-pressure reheater HP is disposed. In other words, if there is a passage in which the dampers are closed, the combustion gas does not flow through that passage but flows through the passages where the dampers are opened. Moreover, even if the dampers are opened, the flow rate of the combustion gas would vary depending upon a degree of opening of the dampers.

In a boiler shown in FIG. 6, a rear gas duct is provided with a partition wall 62 which intersects side walls 61 of the rear gas duct perpendicular thereto. Thus, the rear gas duct is divided into two passages. Furthermore, two partition walls 63 are provided parallel to the side walls 61 of the rear gas duct, to divide the passage that is nearer to the tunnel section 64 into three passages. In the passage positioned at the center of the passage rearer the tunnel section 64 a high-pressure reheater HP is disposed; low pressure reheaters LH are disposed in the passages positioned close to the side walls 61 of the rear gas duct, respectively. A superheater SH is disposed in the remaining passage. In the respective passages where the low-pressure reheater LP, the high-pressure reheater HP and the superheater SH are disposed, dampers are disposed proximate the lower ends of the partition walls 62 and 63.

Combustion gas coming from a furnace 65 passes through the tunnel section 64, and thereafter enters the rear gas duct. At this moment, the combustion gas passes through only the passage in which the superheater SH is disposed if the dampers in the passages where the low-pressure reheater LP and the high-pressure reheater HP are disposed are closed. The combustion gas passes through the passages where the low-pressure reheater LP and the superheater SH are disposed if the dampers in the passage in which the high-pressure reheater HP is disposed are closed. In other words, if there is a passage in which the dampers are closed, then the combustion gas does not flow through that passage but flows through the other passages where the dampers are opened. In addition, even if the dampers are opened, the flow rate of the combustion gas would vary depending upon a degree of opening of the dampers.

The boiler shown in FIG. 5 has the following shortcomings. The high-pressure reheater HP and the superheater SH are formed by extending heat transfer tubes in parallel to the side walls 51 of the rear gas duct and bending them downwards in the proximity of the walls so as to take a zig-zag path. The widths of the passages where the high-pressure reheater HP and the superheater SH are disposed are narrow. Hence, a proportion of a straight tube portion disposed in the passages as small, and the portion of the heat transfer tubes that is effectively available as a heat transfer surface is reduced. Upon fabricating the high-pressure reheater HP and the superheater SH the number of steps of bending tubes is increased, thus an amount of work is increased. Furthermore, when a gas duct evaporator is disposed on the downstream side of the high-pressure reheater HP, since inlet communication tubes of the gas duct evaporator are small in diameter and large in number, the arrangement thereof becomes complex. Or else, if the heat transfer tubes are extended in parallel to the widthwise direction of the furnace rather than in parallel to the side walls 51, then the lengths of the tubes would become long and the number of tubes would become small. Consequently, a pressure loss becomes excessively large.

On the other hand, the boiler shown in FIG. 6 has the following. Since the low-pressure reheater LP system is not disposed in a passage through which all of the combustion gas flows, the necessary heat transfer surface area is excessively increased. Moreover, since the low-pressure reheater is disposed in a passage divided along the widthwise direction of the furnace, a number of elements thereof becomes small and an increase in pressure loss occurs.

SUMMARY OF THE INVENTION

It is therefore one object of the present invention to provide an improved boiler which is free from the above-mentioned shortcomings of the boilers in the prior art.

According to one feature of the present invention, there is provided a boiler consisting of a furnace, a tunnel section at an upper portion of said furnace and a rear gas duct in which a partition wall intersecting with side walls of said rear gas duct perpendicular thereto is disposed to divide said rear gas duct into two passages. The width of the divided passage on the side near to the tunnel section is narrower than the other. A low-pressure reheater is disposed in said narrower divided passage. Two partition walls extending parallel to the side walls of rear gas duct are disposed in said the other said divided passage so as to further divide it into three passages. A superheater or superheaters and a high-pressure reheater or high-pressure reheaters are disposed respectively in said three further divided passages.

In the supercritical sliding pressure operation boiler, in order to ensure safety of the furnace, the enthalpy level of the furnace must always be kept low (at the wet steam region in the subcritical range). For the enthalpy level of the furnace to be kept low even when the load is rapidly varied, or when the plant is operated under conditions other than the planned operational conditions, every divided passage in the rear gas duct must be provided with the gas duct evaporator. This is essential to the present invention.

The above-mentioned and other features and objects of the present invention will become more apparent by reference to the following description of preferred embodiments of the invention taken in conjunction with the accompanying drawings.

DESCRIPTION OF THE PREFERRED EMBODIMENTS

Figure 2:
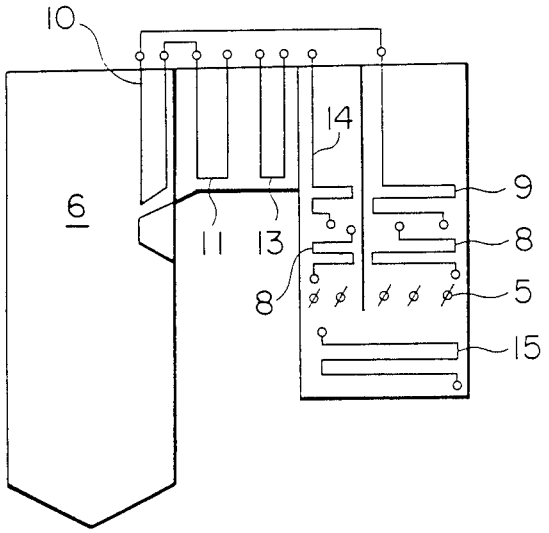
FIG. 2 is a schematic vertical cross-section view of the same boiler taken along line II—II in FIG. 1 as viewed in the direction of arrows.
Figure 3:
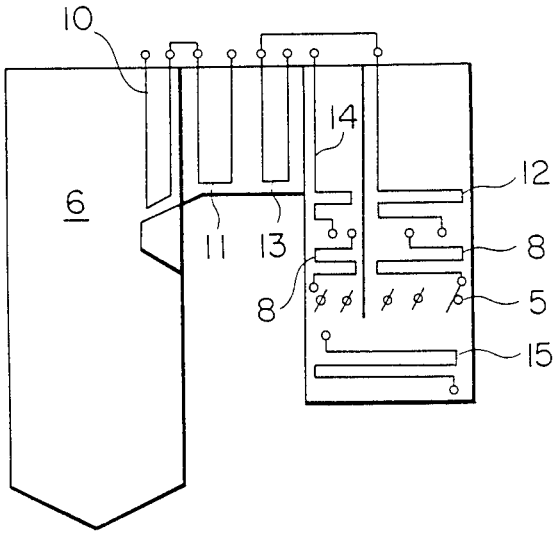
FIG. 3 is a schematic vertical cross-section view of the same boiler taken along line III—III in FIG. 1 as viewed in the direction of arrows.

Now the present invention will be described in greater detail in connection to the preferred embodiment thereof illustrated in FIGS. 1 to 3.

Figure 1:
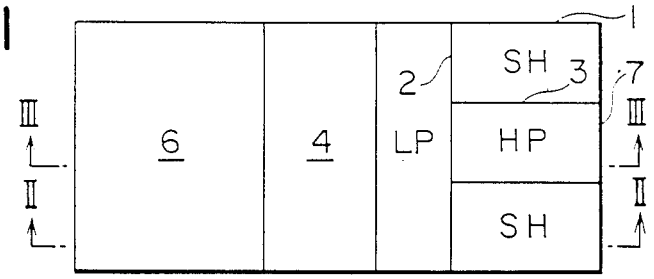
FIG. 1 is a schematic horizontal cross-section view of a boiler according to one preferred embodiment of the present invention.

At first, referring to FIG. 1, a single partition wall 2 is disposed within a rear gas duct so as to be perpendicular to side walls 1 of the rear gas duct, whereby the rear gas duct is divided into two passages in such a manner that the width of the divided passage on the side nearer to a tunnel section 4 is narrower than the other. A low-pressure reheater LP, 14, is disposed in the passage on the side nearer to the tunnel section 4. Two partition walls 3 extending parallel to the side walls 1 of the rear gas duct are disposed in the remaining divided passage of the rear gas duct to further divide the remaining passage into three passages. Superheaters SH, 9, are disposed in the passages close to the side walls 1 of the rear gas duct, and a high-pressure reheater HP, 12 is disposed in the central passage. In the passages where the low-pressure reheater LP, the high pressure reheater HP and the superheaters SH are disposed, dampers 5 are arranged proximate the lower ends of the partition walls 2 and 3. On the downstream side of the low-pressure reheater LP and the high-pressure reheater HP, respectively, gas duct evaporators 8 are disposed between these reheaters and the dampers 5. Also on the downstream side of the superheater SH a gas duct evaporator 8 is disposed between the superheater SH and the dampers 5. Thus, a gas duct evaporator is provided in every divided passage of the rear gas duct for keeping the enthalpy level of the furnace low. At an outlet of a furnace 6 a pendant type of secondary superheater 10 is disposed. In the tunnel section 4 a pendant type of tertiary superheater 11 and a pendant type of high-pressure secondary reheater 13 are disposed in succession from the upstream side. On the downstream side of the dampers 5 an economizer 15 is disposed.

Combustion gas coming from the furnace 6 passes through the tunnel section 4 and thereafter enters the rear gas duct. At this moment, if the dampers 5 in the passages where the low-pressure reheater LP and the high-pressure reheater HP are disposed are closed, while the dampers 5 in the passage in which the superheater SH is disposed, is opened, then the combustion gas passes through only the passage in which the superheater SH is disposed. Whereas, if the dampers 5 in the passage in which the high-pressure reheater HP is disposed, are closed, while the dampers 5 in the passages where the low-pressure reheater LP and the superheater SH are disposed, are opened, then the combustion gas passes through the passages where the low-pressure reheater LP and the superheater SH are disposed. In other words, if there is a passage in which the dampers 5 are closed, then the combustion gas would not flow through that passage but would flow through a passage or passages where the dampers 5 are opened. Even if the dampers 5 are opened, a flow rate of combustion gas would vary depending upon a degree of opening of the dampers. Therefore, proportions of superheating in the low-pressure reheater LP, the high-pressure reheater HP and the superheater SH can be controlled.

According to the above-described design of boilers, the passages where the high-pressure reheater HP and the superheater SH are disposed can be made relatively wide. Therefore a straight tube portion of the heat transfer tubes forming the high-pressure reheater HP and the superheater SH can be made large, so that the portion of the heat transfer tubes that is effectively available as a heat transfer surface is increased. A reduction in heat transfer efficiency can be prevented. Also, the number of portions of the tubes to be bent are reduced, and reduction of an amount of work is making the tubes becomes possible. Furthermore, since the high-pressure reheater HP is disposed on the side of a rear wall 7 of the rear gas duct, even in the case where the gas duct evaporator is disposed below the high-pressure reheater HP, the large number of inlet communication tubes having a small diameter of the gas duct evaporator can be simply introduced through the rear wall 7. The gas duct evaporator can be simply disposed also.

Figure 4:
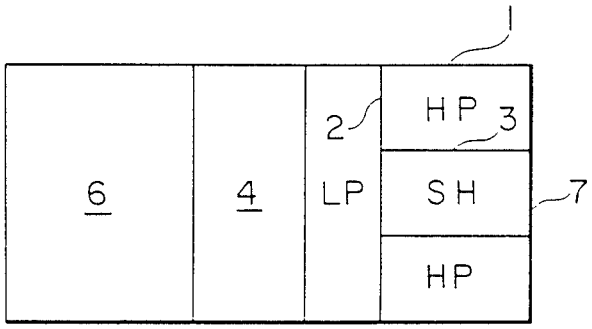
FIG. 4 is a schematic horizontal cross-section view of a boiler according to another preferred embodiment of the present invention.
Figure 5:
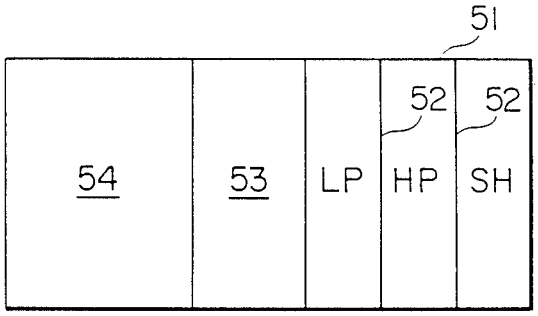
FIG. 5 PRIOR ART
FIGS. 5 and 6 are schematic horizontal cross-section views of two different types of boilers in the prior art.
Figure 6:
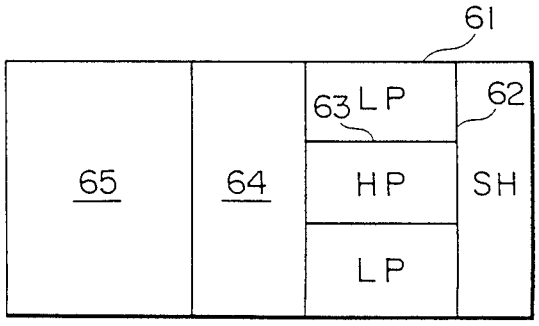
FIG. 6 PRIOR ART

It is to be noted that the superheaters SH are disposed in the passages close to the side walls 1 of the rear gas duct and the high-pressure reheater HP is disposed in the central passage in the above-described first preferred embodiment. Even if that arrangement of the superheater SH and the high-pressure reheater HP is reversed such that the high-pressure reheaters HP are disposed in the passages close to the side walls 1 of the rear gas duct and the superheater SH is disposed in the central passage as shown in FIG. 4, the same operations and advantages of the first preferred embodiment are provided.

In the boiler according to the present invention, a tunnel section is provided at an upper portion of the furnace. A partition wall intersects side walls of the rear gas duct perpendicular thereto to divide the rear gas duct into two passages so that the width of the divided passage on the side near to the tunnel section is narrower than the other. A low-pressure reheater is disposed in the narrower divided passage. Two partition walls extending parallel to the side walls of the rear gas duct are disposed in the other divided passage so as to further divide it into three passages. A superheater or superheaters and a high-pressure reheater or high-pressure reheaters are disposed respectively in the further divided passages; the depths of the passages in which the high-pressure and low-pressure reheaters and the superheater are disposed can be made large. Therefore, a straight tube portion of the heat transfer tubes forming the high-pressure and low-pressure reheaters and the superheater can be made large. Hence, the portion of the heat transfer tubes that is effectively available as a heat transfer surface is increased, reduction in a heat transfer efficiency can be prevented, and the number of portions of the tubes to be bent is reduced, thereby reducing an amount of work to make the tubes. Furthermore, since it is possible to concentrate the flow of the combustion gas to the passage where the superheater is disposed, the flow of the combustion gas into the passages where the high-pressure and low-pressure reheaters are disposed can be minimized. Thus, the heat transfer tubes of the high-pressure and low-pressure reheaters can be protected even if abrupt throw-in of fuel is effected, and so, shortening of a starting period becomes possible.

While a principle of the present invention has been described above in connection to preferred embodiments of the invention, it is intended that all matter contained in the above description and illustrated in the accompanying drawings shall be interpreted to be illustrative and not as a limitation to the scope of the invention.

What is claimed is:

1. A boiler comprised of:

a furnace;

a tunnel section located adjacent to and at an upper section of said furnace;

a rear gas duct located adjacent said tunnel section opposite from said furnace, said rear gas duct having side walls, a rear wall, and a partition wall means disposed perpendicular to said side walls and spaced from said rear wall for defining a first passage means of said rear gas duct adjacent said tunnel section between said side walls and partition wall means and a second passage means of said rear gas duct adjacent said first passage means between said side walls, rear wall and partition wall means, said first passage means having a width as measured along said side walls narrower than the width of said second passage means as measured along said side walls, a low pressure reheater disposed in said first passage means, said second passage means having two partition walls extending parallel to and spaced from said side walls for defining first, second and third passages in said second passage means, and at least on superheater and one high-pressure reheater disposed in said second passage means, said first, second and third passages of said second passage means each having a respective one of said superheater and said high-pressure reheater disposed therein; and a respective gas duct evaporator in each of said first passage means, said first passage, said second passage and said third passage.

2. The boiler claimed in claim 1 wherein, said first and third passages of said second passage means are each located between one of said two partition walls and a respective side wall of said rear gas duct, said first and third passages of said second passage means having a said superheater located therein;

said second passage of said second passage means is located between said two partition walls, said second passage having a said high-pressure reheater located therein.

3. The boiler claimed in claim 1, wherein, said first and third passages are each located between one of said two partition walls and a respective side wall of said rear gas duct, said first and third passages of said second passage means having a said high-pressure reheater located therein;

said second passage of said second passage means is located between said two partition walls, said second passage having a superheater located therein.

* * * * *